US008683659B2

(12) United States Patent
Cheng

(10) Patent No.: US 8,683,659 B2
(45) **Date of Patent: *Apr. 1, 2014**

(54) RELEASABLE TIE

(71) Applicant: K.S. Terminals Inc., Changhua County (TW)

(72) Inventor: Juei-Ching Cheng, Changhua County (TW)

(73) Assignee: K.S. Terminals Inc., Changhua County (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/930,645

(22) Filed: Jun. 28, 2013

(65) Prior Publication Data

US 2013/0291342 A1 Nov. 7, 2013

Related U.S. Application Data

(63) Continuation of application No. 12/896,534, filed on Oct. 1, 2010, now Pat. No. 8,499,419.

(30) Foreign Application Priority Data

Sep. 3, 2010 (TW) ..... 99129780 A

(51) Int. Cl.
*B65D 63/10* (2006.01)

(52) U.S. Cl.
USPC ..... 24/16 PB; 24/17 AP

(58) Field of Classification Search
USPC ..... 24/16 PB, 16 R, 17 A, 17 AP; 248/74.3, 248/74.4
IPC ..... B65D 63/00,63/10
See application file for complete search history.

(56) References Cited

U.S. PATENT DOCUMENTS

| | | | | | |
|---|---|---|---|---|---|
| 3,102,311 | A | * | 9/1963 | Martin et al. | 24/16 PB |
| 3,486,201 | A | * | 12/1969 | Bourne | 24/16 PB |
| 3,660,869 | A | | 5/1972 | Caveney et al. | |
| 3,672,003 | A | | 6/1972 | Morgan | |
| 3,872,547 | A | | 3/1975 | Caveney et al. | |
| 3,908,233 | A | | 9/1975 | Caveney et al. | |
| 3,973,292 | A | * | 8/1976 | Bonnet | 24/16 PB |
| 4,011,633 | A | | 3/1977 | Seil | |
| 4,191,334 | A | | 3/1980 | Bulanda et al. | |

(Continued)

FOREIGN PATENT DOCUMENTS

| | | | |
|---|---|---|---|
| JP | 09040003 | A | 2/1997 |
| JP | 2004081489 | A | 3/2004 |

*Primary Examiner* — Robert J Sandy
*Assistant Examiner* — Louis Mercado
(74) *Attorney, Agent, or Firm* — Ming Chow; Sinorica, LLC

(57) ABSTRACT

A releasable tie includes a locking head and a strap body. The locking head includes a base plate, a pair of first side walls, a second side wall, and an operating rod. The operating rod is disposed above a window of the base plate, has a first top surface, and is bilaterally connected to the first side walls via connecting members. One first engaging tooth is provided at a predetermined depth extending vertically downward from the first top surface. The first engaging tooth has a second top surface which defines a first tooth depth. The operating rod includes an arm extending toward the strap body. The strap body has a bottom surface formed with plural second engaging teeth engageable with the first engaging tooth. The second engaging teeth have a predetermined tooth pitch smaller than the predetermined depth and a second tooth depth smaller than the first tooth depth.

4 Claims, 5 Drawing Sheets

(56) References Cited

U.S. PATENT DOCUMENTS

| | | | | | |
|---|---|---|---|---|---|
| 4,473,524 | A | | 9/1984 | Paradis | |
| 4,658,478 | A | * | 4/1987 | Paradis | 24/16 PB |
| 4,665,588 | A | | 5/1987 | Nakano | |
| 4,688,302 | A | | 8/1987 | Caveney et al. | |
| 4,805,856 | A | * | 2/1989 | Nicoli et al. | 248/74.3 |
| 5,193,250 | A | * | 3/1993 | Caveney | 24/16 PB |
| 5,267,373 | A | * | 12/1993 | Chisek | 24/16 PB |
| 5,317,787 | A | * | 6/1994 | Fortsch | 24/16 PB |
| 5,398,383 | A | * | 3/1995 | Bingold | 24/16 PB |
| 5,440,786 | A | * | 8/1995 | Sorensen et al. | 24/16 PB |
| 5,470,520 | A | * | 11/1995 | Sorensen et al. | 264/297.2 |
| 5,593,630 | A | * | 1/1997 | Sorensen et al. | 264/219 |
| 5,884,367 | A | * | 3/1999 | Teagno et al. | 24/16 PB |
| 6,149,109 | A | | 11/2000 | Stankowski | |
| 6,185,791 | B1 | | 2/2001 | Khokhar | |
| 7,540,069 | B2 | | 6/2009 | Okamoto | |
| 2003/0229972 | A1 | | 12/2003 | Welch | |
| 2008/0028576 | A1 | | 2/2008 | Okamoto | |
| 2008/0083094 | A1 | | 4/2008 | Hsu et al. | |

* cited by examiner

RELEASABLE TIE

CROSS-REFERENCE TO RELATED APPLICATIONS

This application is a Continuation Application of U.S. patent application Ser. No. 12/896,534 entitled "RELEASABLE TIE" filed on Oct. 1, 2010, NOW U.S. Pat. No. 8,499,419, which claimed a priority to the foreign patent application in Taiwan with filing No. TW099129780, filed on Sep. 3, 2010.

BACKGROUND OF THE INVENTION

1. Technical Field

The present invention relates to a tie for tying objects together and, more particularly, to a releasable tie.

2. Description of Related Art

Ties are commonly used to tie and fasten ordinary power cords or other objects to be bundled, for the convenience of storage. However, commercially available ties, once tightened, cannot be released. Therefore, when it is desired to add more objects to a tied bundle or rearrange the objects already tied up, the tie in use must be cut and be replaced by a new one, which is not only inconvenient and costly, but also a waste of resources.

Moreover, well-known bands/ties are easily getting loose when the inserted bands/ties are subjected to external force and a user might feel uncomfortable while pulling the bands/ties due to the resistance. For example, a binding band, a plastic bundling tie, and a one-piece cable tie are disclosed as prior arts in US Publication No. 2008/0028576, JP Patent No. 09040003, and U.S. Pat. No. 4,688,302, respectively. Although these bands/ties could provide bundling functions, however, the locking part (indicated with a numeral 24) of the enclosed-wall part (indicated with a numeral 20) disclosed in US Publication No. 2008/0028576, the pawl (indicated with a numeral 8) of the bundle stopper (indicated with a numeral 3) disclosed in JP Patent No. 09040003, and the pawl (indicated with a numeral 150) of the frame (indicated with a numeral 120) disclosed in U.S. Pat. No. 4,688,302 are easily overturned and therefore makes the inserted band, bundle body or strap being loose when the inserted band, bundle body or strap is subjected to external force.

BRIEF SUMMARY OF THE INVENTION

In order to overcome the aforesaid drawback of the prior arts such as US Publication No. 2008/0028576, JP Patent No. 09040003, and U.S. Pat. No. 4,688,302, the present invention provides a releasable tie which includes a locking head and a strap body. The locking head is formed with a window. The strap body has a first end and a second end. The first end is connected to the locking head. The second end can be inserted through the window and be engaged with the locking head so as to be fixed in position thereto.

In addition, the locking head includes a base plate, a pair of first side walls, a second side wall, and an operating rod. The base plate is formed with the window of the locking head and has a front end and a rear end. The pair of first side walls are provided on the two lateral sides of the base plate respectively. The second side wall is disposed at the front end of the base plate and has two lateral sides connected to the first side walls respectively. The operating rod is provided above the window of the base plate and is bilaterally connected to the first side walls via connecting members. The operating rod has a first top surface. At least one first engaging tooth is provided at a predetermined depth extending vertically downward from the first top surface. The at least one first engaging tooth has a second top surface which defines a first tooth depth. The operating rod further includes an arm extending from the operating rod toward the strap body.

The strap body has a third top surface and a bottom surface, wherein the third top surface is closer to the arm of the operating rod than the bottom surface is. The bottom surface is provided with a plurality of second engaging teeth which are engageable with the first engaging tooth of the operating rod. The second engaging teeth have a predetermined tooth pitch and a second tooth depth. The first tooth depth is greater than the second tooth depth, and the predetermined depth is greater than the predetermined tooth pitch.

Therefore, the primary object of the present invention is to provide the foregoing releasable tie wherein, after the strap body is inserted through the window of the locking head and because the first tooth depth of the first engaging tooth is greater than the second tooth depth of the second engaging teeth, a small gap is formed between the first engaging tooth and the second engaging teeth engaged therewith. Consequently, the entry resistance of the strap body is reduced in comparison with the prior art to facilitate insertion of the strap body through the window.

Another objective of the present invention is to provide the foregoing releasable tie which is characterized by the predetermined depth between the first top surface of the operating rod and the first engaging tooth and the predetermined tooth pitch of the second engaging teeth, and wherein the second engaging teeth of the strap body are engaged with the first engaging tooth of the operating rod when the strap body is inserted into the window of the locking head in a first direction. The predetermined depth, being greater than the predetermined tooth pitch, can accommodate least two of the second engaging teeth at the same time to increase the resistance of the releasable tie against pulling.

Another objective of the present invention is to provide the foregoing releasable tie wherein, the first top surface of the operating rod of the locking head has an extension length. With the extension length, the operating rod will not be easily overturned when the strap body is subjected to external force, but will be pressed against the strap body to keep the strap body from getting loose from the locking head.

Another objective of the present invention is to provide the foregoing releasable tie wherein, with the arm extending from the operating rod, a user can easily apply a force to the arm to disengage the at least one first engaging tooth of the operating rod from the second engaging teeth of the strap body, thus allowing the second end of the strap body to be pulled out of the window of the locking head. As such, the releasable tie features easy operation, repeated use, and hence a low cost of use.

BRIEF DESCRIPTION OF THE SEVERAL VIEWS OF THE DRAWINGS

The structure as well as a preferred mode of use, further objects, and advantages of the present invention will be best understood by referring to the following detailed description of an illustrative embodiment in conjunction with the accompanying drawings, in which.

DETAILED DESCRIPTION OF THE INVENTION

The present invention discloses a releasable tie, wherein the engaging teeth employed and the principle of engagement between the engaging teeth for achieving a fixing effect are well known to a person of ordinary skill in the art and hence are not be detailed herein. Besides, it should be understood that the drawings referred to in the following description are not necessarily drawn to scale, for they are intended to demonstrate the features of the present invention only schematically.

Figure 1:
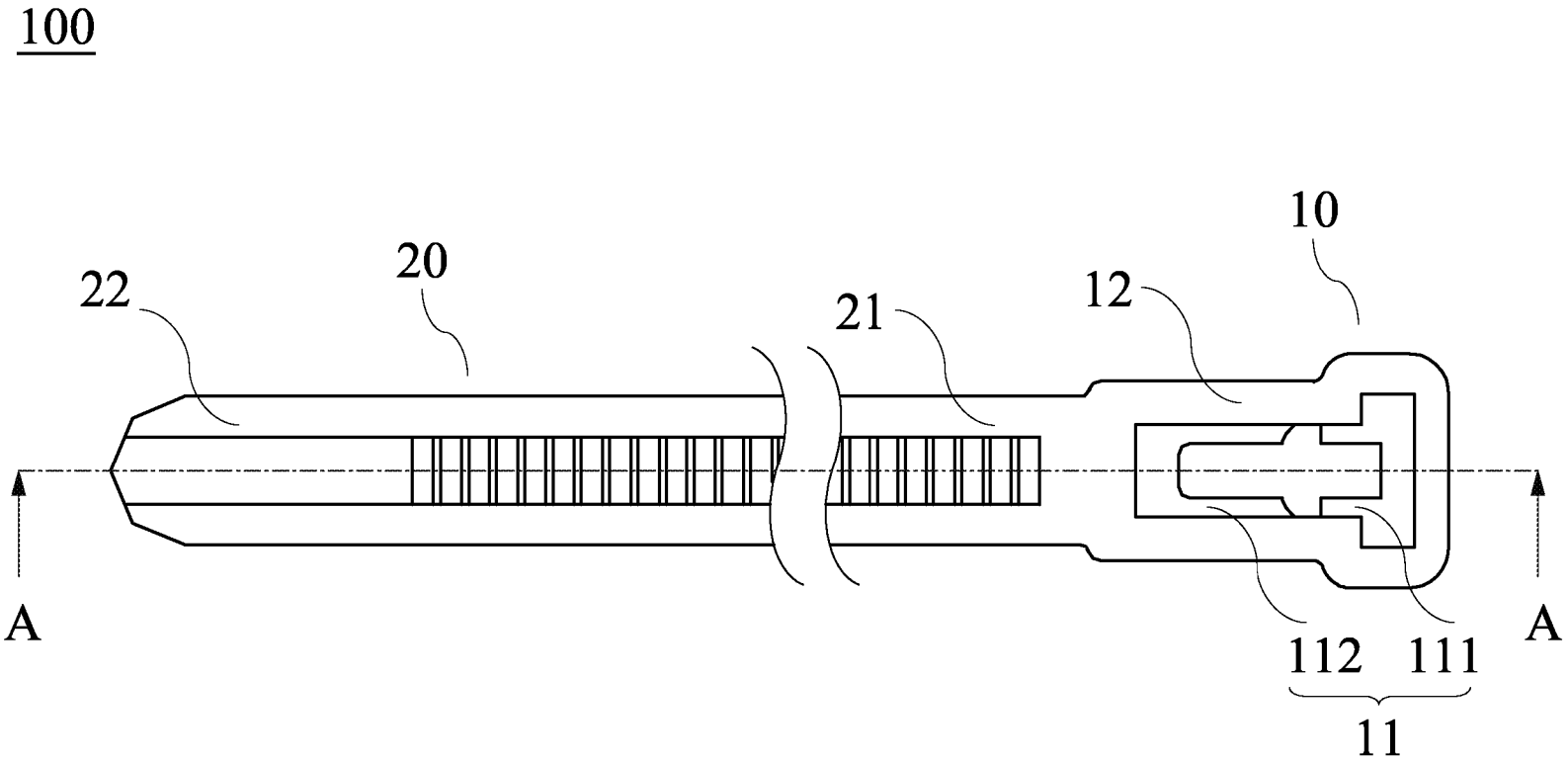
FIG. 1 is a schematic drawing of a releasable tie according to a preferred embodiment of the present invention.

Referring to FIG. 1, a releasable tie 100 according to a preferred embodiment of the present invention includes a locking head 10 and a strap body 20. The locking head 10 is formed with a window 11, wherein the window 11 has a first window portion 111 and a second window portion 112. The strap body 20 has a first end 21 and a second end 22. The first end 21 is connected to the locking head 10. The second end 22 can be inserted through the first window portion 111 of the window 11 of the locking head 10 and be engaged with the locking head 10 so as to be fixed in position thereto and tie objects together.

Figure 2:
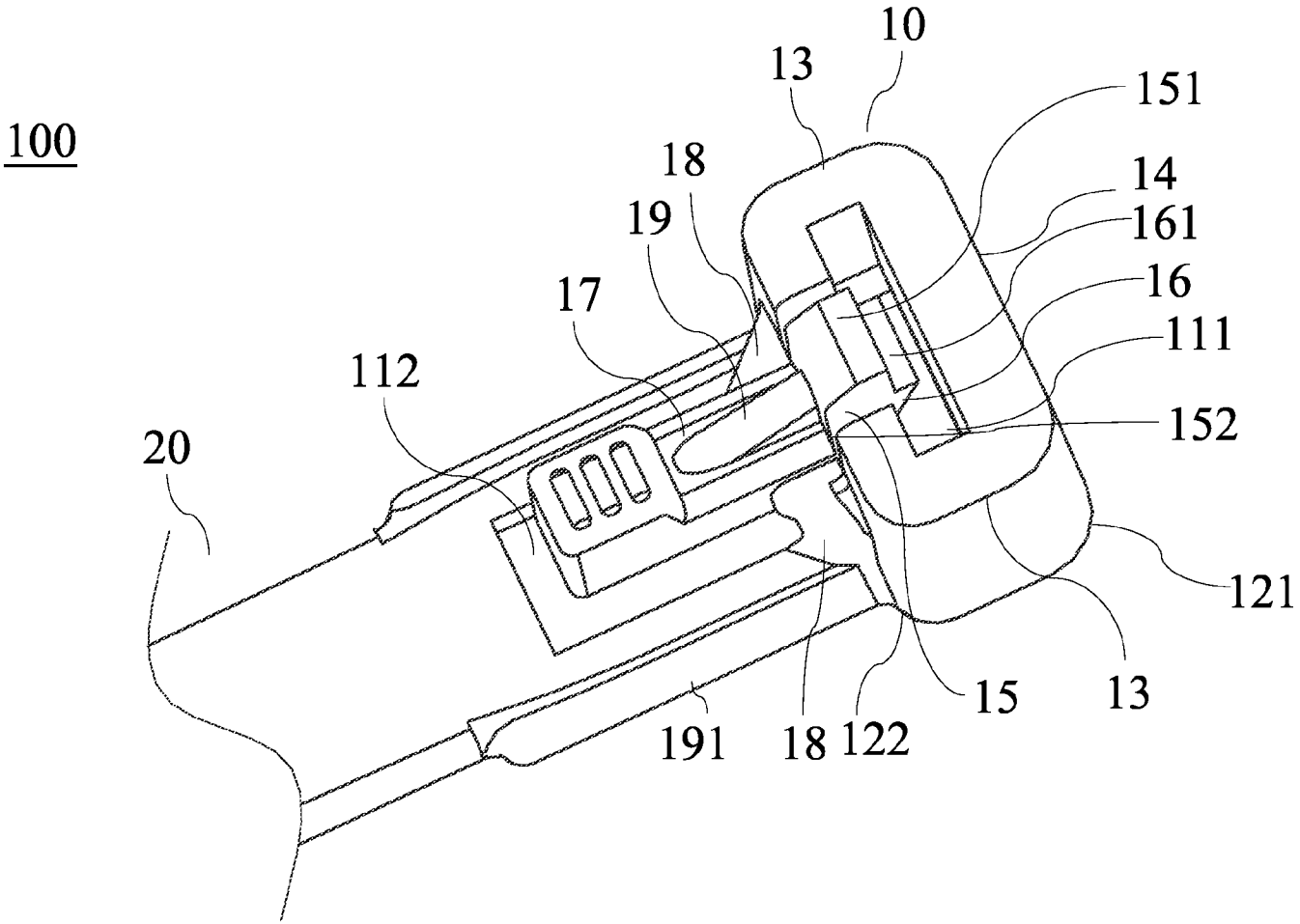
FIG. 2 is a perspective view of the releasable tie according to a preferred embodiment of the present invention.

With reference to FIG. 2, which is a perspective view of the releasable tie 100, the locking head 10 includes a base plate 12 (see FIG. 1), a pair of first side walls 13, a second side wall 14, and an operating rod 15. The base plate 12 has a front end 121 and a rear end 122 and two lateral sides. The first end 21 of the strap body 20 is connected to the rear end 122 of the base plate 12 of the locking head 10. Also, the firs window portion 111 of the locking head 10 is provided at the base plate 12 and enclosed by the first side walls 13 and the second wall 14. The pair of first side walls 13 are located on the two lateral sides of the base plate 12 respectively. The second side wall 14 is disposed at the front end 121 of the base plate 12 and has two lateral sides which are connected to the first side walls 13 respectively. The operating rod 15 is provided above the first window portion 111 and includes a portion having a first top surface 151 formed above the window 11. In addition, the operating rod 15 is bilaterally connected to each of the first side walls 13 via connecting members 18. The connecting members 18 are also connected to an arm 17 of the operating rod 15.

Figure 3:
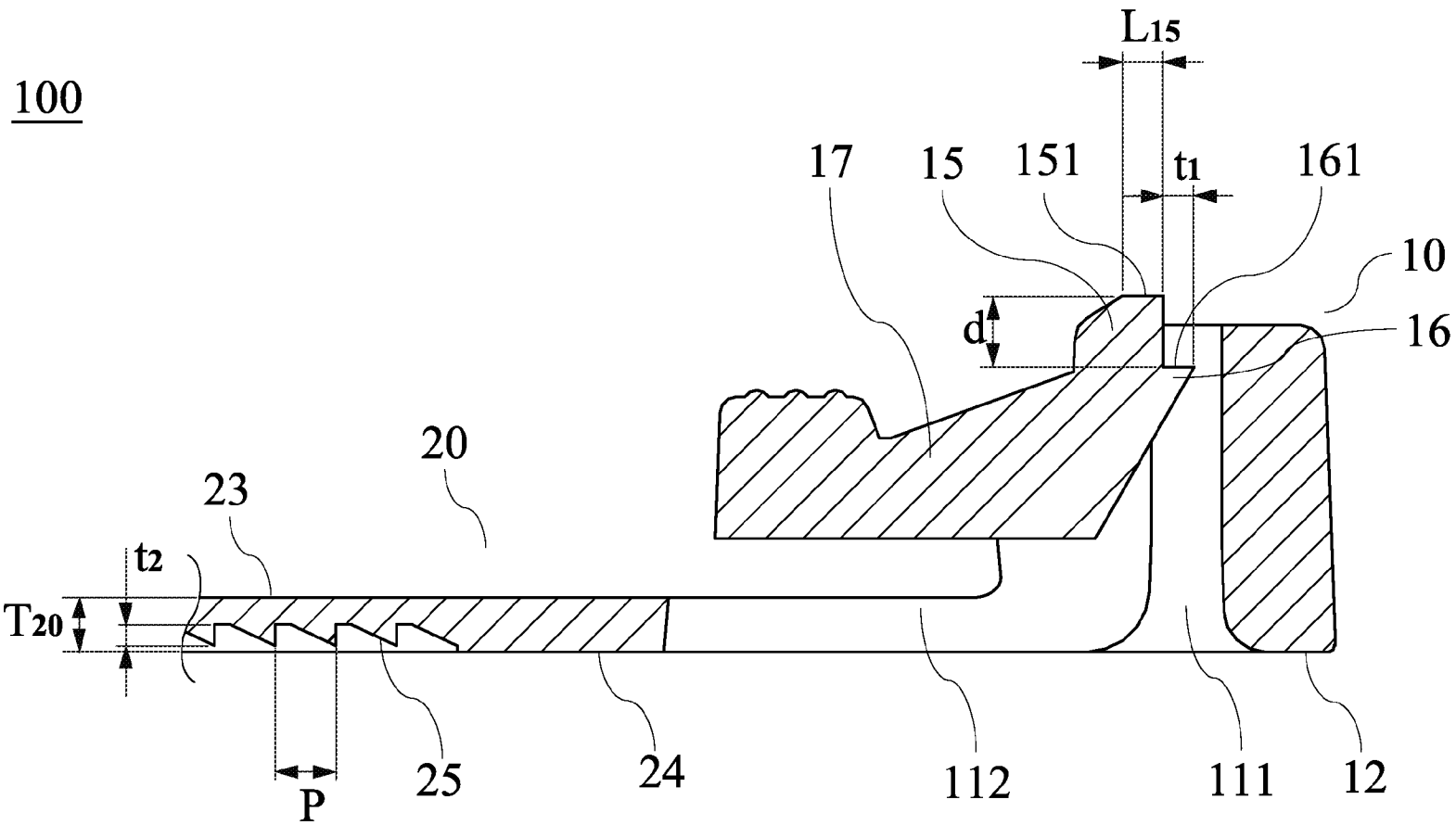
FIG. 3 is a sectional view of the releasable tie of FIG. 1 taken along Line A-A.

Referring to FIG. 3, which is a sectional view taken along line A-A of FIG. 1, the operating rod 15 has a predetermined depth d extending vertically downward from the first top surface 151, and at least one (e.g., two, three, etc.) first engaging tooth 16 is provided at the predetermined depth d. The first engaging tooth 16 has a second top surface 161 which defines a first tooth depth t1. The first top surface 151 is preferably parallel to the second top surface 161. As mentioned previously, the operating rod 15 includes an arm 17 extending from the operating rod 15 toward the second window portion 112 and the strap body 20. Furthermore, the operating rod 15 has a waist portion 152 (see FIG. 2). The arm 17 preferably extends from the waist portion 152 of the operating rod 15 toward the strap body 20. The strap body 20 has a third top surface 23 and a bottom surface 24. The third top surface 23 of the strap body 20 is closer to the arm 17 of the operating rod 15 than the bottom surface 24 is.

Figure 4:
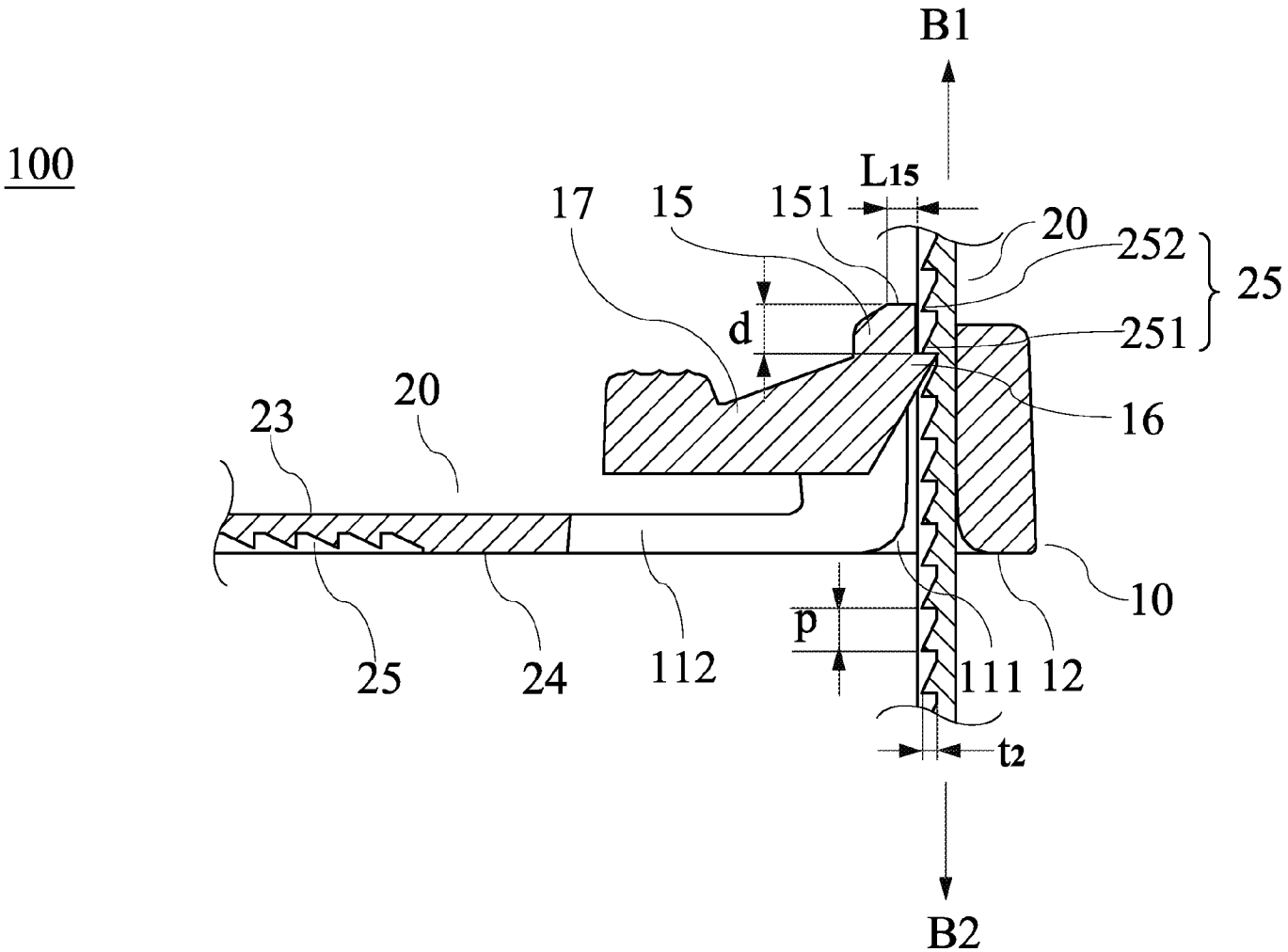
FIG. 4 is another sectional view of the releasable tie according to a preferred embodiment of the present invention.

FIG. 4 is a sectional view showing insertion of the strap body 20 through the locking head 10, wherein the strap body 20 is inserted through the locking head 10 in a first direction B1 so as to tie objects (not shown) together. When it is desired to pull the strap body 20 out of the locking head 10, the strap body 20 should be pulled in a second direction B2. The bottom surface 24 of the strap body 20 is provided with a plurality of second engaging teeth 25 for engaging with the first engaging tooth 16 of the operating rod 15. The second engaging teeth 25 have a predetermined tooth pitch p, and each second engaging tooth 25 has a second tooth depth t2. It is important that the first tooth depth t1 (see FIG. 3) is slightly greater than the second tooth depth t2, and the predetermined depth d is greater than the predetermined tooth pitch p.

Referring to FIG. 4, when it is desired to tie objects with the releasable tie 100, the strap body 20 is wound around the objects, inserted into the locking head 10 in the first direction B1, and then pulled in the first direction B1 until the objects are fastened by the strap body 20. To prevent the strap body 20 from being pulled out of the locking head 10 in the second direction B2, the operating rod 15 must have adequate resistance against such a pulling action.

Generally speaking, when the strap body 20 is pulled in the second direction B2, the operating rod 15 tends to be overturned, thus allowing the strap body 20 to disengage from the locking head 10 with ease. However, referring to FIG. 4, experiment results have shown that, as long as the arm 17 is not pressed downward, the operating rod 15 will not be easily overturned or is prevented from being overturned when the strap body 20 is pulled in the second direction B2. This is because, with the predetermined depth d being greater than the predetermined tooth pitch p, not only is the second engaging tooth 251 tightly engaged with the first engaging tooth 16 of the operating rod 15, but also the operating rod 15 is pressed against the second engaging tooth 252 when the strap body 20 is pulled in the second direction B2. Consequently, disengagement between the second engaging tooth 251 and the first engaging tooth 16 is unlikely unless the arm 17 is pressed. Therefore, in order to prevent the strap body 20 from being pulled out of the locking head 10 and increase the resistance of the releasable tie 100 against such pulling actions, it is necessary that the predetermined depth d be able to accommodate at least two second engaging teeth 251, 252. In other words, the predetermined depth d must be greater than the predetermined tooth pitch p of the strap body 20.

As stated above, when it is desired to tie objects with the releasable tie 100 of the present invention, the strap body 20 is wound around the objects, and then the second end 22 of the strap body 20 is inserted through the locking head 10 in the first direction B 1. While doing so, the second engaging teeth 25, 251, 252 of the strap body 20 push the first engaging tooth 16 of the operating rod 15 in the first direction B1 such that the operating rod 15 is tilted toward the rear end 122 of the base plate 12. As the first tooth depth t1 of the first engaging tooth 16 is slightly greater than the second tooth depth t2 of the second engaging teeth 25, the first tooth depth t1 stays clear of the second tooth depth t2 when the second end 22 of the strap body 20 is pulled in the first direction B1 to make a bundle of the objects. Hence, while pulling the strap body 20, the user would feel no resistance but a smooth glide. Compared with the prior art, entry of the strap body 20 into the window 11 is made easier.

It should be particularly noted that the predetermined depth d is preferably more than 1.5 times as great as the predetermined tooth pitch p, and the first tooth depth t1 is preferably slightly greater than the second tooth depth t2 by 0.05 mm to 0.1 mm.

Furthermore, as shown in FIG. 4, the first top surface 151 has an extension length L15 which is greater than the first tooth depth t1 (see FIG. 3) and serves to prevent the operating rod 15 from being overturned. More specifically, if the strap body 20, after being inserted through the window 11 of the locking head 10 in the first direction B1, is pulled in the second direction B2 in an attempt to remove the strap body 20 from the locking head 10, the strap body 20 will be subjected to a great force and tend to overturn the operating rod 15. Should the operating rod 15 be overturned, the strap body 20 will be easily disengaged from the locking head 10. The extension length L15 is provided to prevent the operating rod 15 from being overturned while the strap body 20 is subjected to such a great force. Due to the extension length L15, the operating rod 15 will be pressed even more securely against the strap body 20 instead, thereby preventing the strap body 20 from getting loose from the locking head 10.

In addition, unlike the commercially available releasable ties which require the engaged portion be pushed forcibly by the user's nail or a pointed object to release the engaged portion and thereby loosen the strap body, the releasable tie 100 of the present invention is provided with the arm 17 to facilitate disengagement of the strap body 20 from the locking head 10. The arm 17, which extends from the operating rod 15 toward the strap body 20, can be pushed toward the second window portion 112 of the window 11, thus tilting the operating rod 15 toward the rear end 122 of the base plate 12. As a result, the distance between the first engaging tooth 16 and the second side wall 14 is increased to facilitate removal of the strap body 20 from the window 11 of the locking head 10 along the second direction B2. Consequently, the releasable tie 100 is capable of repeated use, and the cost of use is reduced.

The arm 17 extending from the operating rod 15 can be easily pushed to disengage the first engaging tooth 16 of the operating rod 15 from the second engaging teeth 25 of the strap body 20, thereby allowing the second end 22 of the strap body 20 to be pulled out of the window 11 of the locking head 10. In this regard, the releasable tie 100 of the present invention also features easy operation.

With reference to FIG. 2, in order to reinforce the structure of the locking head 10 and enable repeated use, the releasable tie 100 of the present invention further includes a reinforcing rib 19 which connects the upper half portion of the operating rod 15 and the arm 17. Hence, not only are the operating rod 15 and the arm 17 structurally strengthened, but also the number of times for which the releasable tie 100 of the present invention can be used is increased. Also, in the preferred embodiment of the present invention, a pair of reinforcing elements 191 is provided on the two lateral sides of the base plate 12 of the releasable tie 100 respectively to reinforce the base plate 12 of the releasable tie 100.

Figure 5:
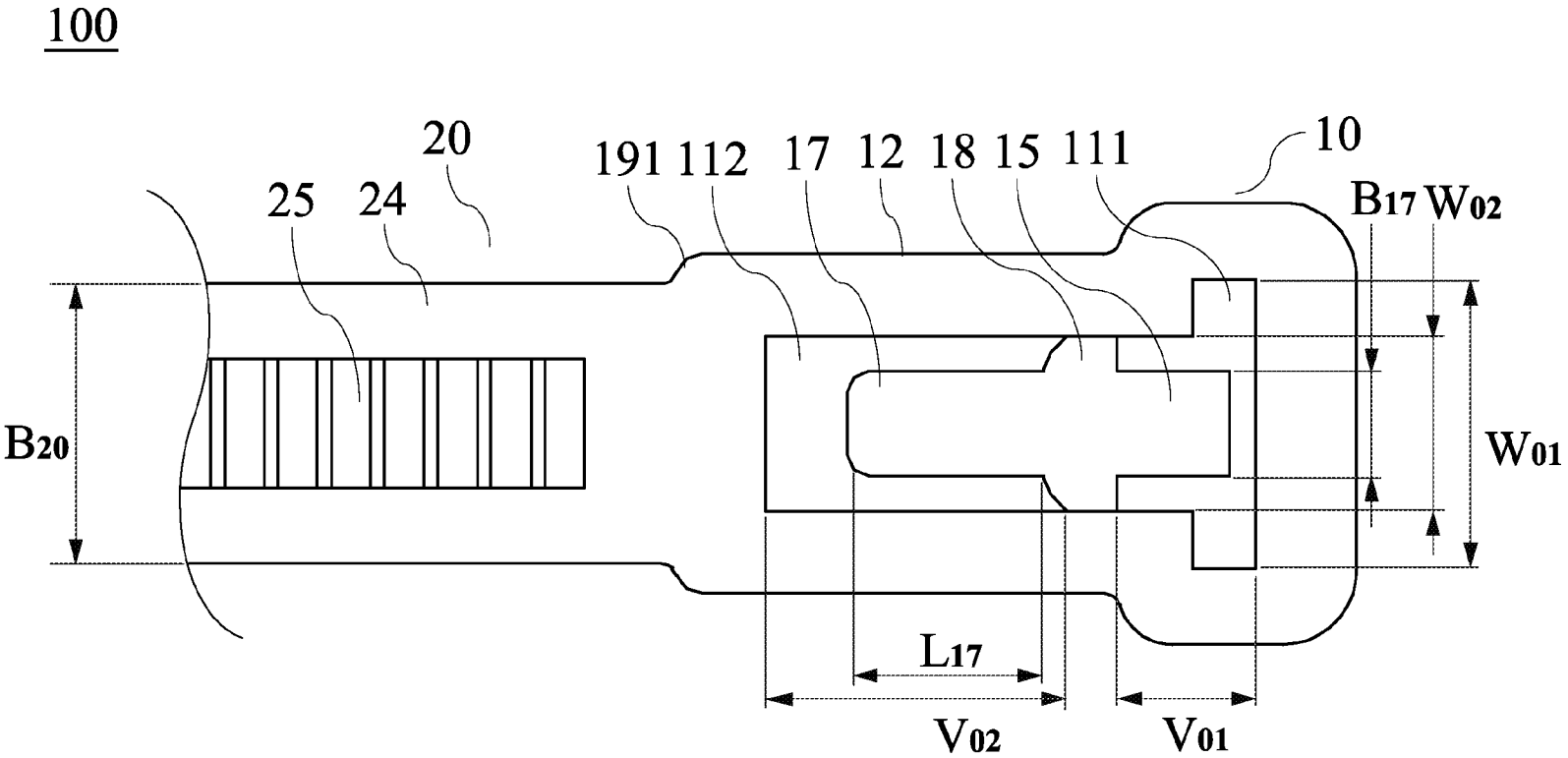
FIG. 5 is a plan view of the releasable tie according to a preferred embodiment of the present invention.

To effectively reduce the production cost of the releasable tie 100 of the present invention and provide the releasable tie 100 with high resistance to external force as well as good operability, the releasable tie 100 is preferably integrally formed. Referring to FIG. 5 for a plan view of the locking head 10 at the level of the base plate 12, the first window portion 111 of the window 11 is closer to the second side wall 14 than the second window portion 112 is. Besides, the area of the first window portion 111 is larger than the cross-sectional area of the strap body 20, and the area of the second window portion 112 is larger than the projected area of the arm 17 of the operating rod 15.

As shown in FIG. 5, the first window portion 111 has a first transverse dimension W01 and a first longitudinal dimension V01. The first transverse dimension W01 is greater than the width B20 of the strap body 20. The first longitudinal dimension V01 is greater than the thickness T20 of the strap body 20 (see FIG. 3).

Referring again to FIG. 5, the second window portion 112 has a second transverse dimension W02 and a second longitudinal dimension V02. The second transverse dimension W02 is greater than the width B 17 of the arm 17. The second longitudinal dimension V02 is greater than the length L17 of the arm 17 (see also FIG. 3).

The aforesaid structure of the window 11 is intended to facilitate the manufacture of molds and is particularly suitable for making small releasable ties 100 of high structural strength and high quality.

The embodiment described above serves to demonstrate the features of the present invention so that a person of ordinary skill in the art can understand the contents disclosed herein and implement the present invention accordingly. The embodiment, however, is not intended to limit the scope of the present invention. All equivalent changes or modifications which do not depart from the spirit of the present invention should fall within the scope of the present invention, which is defined only by the appended claims.

What is claimed is:

1. A releasable tie (100), comprising:

a locking head (10) having a base plate (12) defined by a front end (121), a rear end (122), and two lateral sides; a pair of first side walls (13) respectively provided on the lateral sides of the base plate (12); and a second side wall (14) disposed at the front end (121) of the base plate (12) and laterally connected to the first side walls (13); the base plate (12) being formed with a window (11) including a first window portion (111) enclosed by the first side walls (13) and the second wall (14) and a second window portion (112);

a strap body (20) having a first end (21), a second end (22), a top surface (23) and a bottom surface (24), the first end (21) being connected to the locking head (10), the second end (22) being insertable through the first window portion (111) and engageable with the locking head (10) so as to be fixed in position thereto; and an operating rod (15) being provided above the first window portion (111) with an arm (17) extending from the operating rod (15) toward the second window portion (112) and the strap body (20), the operating rod (15) and the arm (17) are bilaterally connected to each of the first side walls (13) via connecting members (18), the operating rod including a portion having a first top surface (151) formed above the first window portion (111), at least a first engaging tooth (16) being provided at a predetermined depth (d) extending vertically downward from the first top surface (151), the first engaging tooth (16) having a second top surface (161) defining a first tooth depth (t1);

wherein the top surface (23) of the strap body (20) is closer to the arm (17) of the operating rod (15) than the bottom surface (24) of the strap body (20) is, the bottom surface (24) is provided with a plurality of second engaging teeth (25) which are engageable with the first engaging tooth (16) of the operating rod (15), the second engaging teeth (25) have a predetermined tooth pitch (p) and a second tooth depth (t2), the first tooth depth (t1) is slightly greater than the second tooth depth (t2), and the predetermined depth (d) is greater than the predetermined tooth pitch (p);

wherein the first top surface (151) has an extension length (L15) being greater than the first tooth depth (0) and the portion having the first top surface (151) is able to be pressed against at least two of the second engaging teeth (25); and wherein the second window portion (112) is a through hole to allow the arm (17) to pass through the second window portion (112) while the arm (17) is pushed toward the second window portion (112).

2. The releasable tie (100) of claim 1, wherein the first top surface (151) is parallel to the second top surface (161).

3. The releasable tie (100) of claim 1, wherein the predetermined depth (d) is more than 1.5 times as great as the predetermined tooth pitch (p), and the first tooth depth (t1) is slightly greater than the second tooth depth (t2) by 0.05 mm to 0.1 mm.

4. The releasable tie (100) of claim 1, wherein the operating rod (15) has a waist portion (152), and the arm (17) extends from the waist portion (152) of the operating rod (15) toward the strap body (20).

* * * * *